US005992735A

United States Patent [19]

Oosterbaan

[11] Patent Number: 5,992,735

[45] Date of Patent: Nov. 30, 1999

[54] BROADSHEET FROM CARDBOARD FOR CONSTRUCTING A STACKABLE BOX AND THUS OBTAINED BOX

[75] Inventor: Willeke Oosterbaan, Rijswijk, Netherlands

[73] Assignee: Veerstroom B.V., AB Bergen op Zoom, Netherlands

[21] Appl. No.: 09/095,644

[22] Filed: Jun. 11, 1998

[30] Foreign Application Priority Data

Jun. 13, 1997 [EP] European Pat. Off. ..... 97870086

[51] Int. Cl.[6] ..... B65D 21/02

[52] U.S. Cl. ..... 229/191; 229/918

[58] Field of Search ..... 229/191, 915, 229/918

[56] References Cited

U.S. PATENT DOCUMENTS

| | | | |
|---|---|---|---|
| 3,034,698 | 5/1962 | Forrer | 229/191 |
| 3,079,058 | 2/1963 | Russell | 229/191 |
| 3,375,967 | 4/1968 | Robinson | 229/191 |
| 4,056,223 | 11/1977 | Williams | 229/918 |
| 4,546,913 | 10/1985 | Castillo | 229/191 |
| 4,883,221 | 11/1989 | Brundage | 229/918 |

FOREIGN PATENT DOCUMENTS

| | | | |
|---|---|---|---|
| 133579 | 2/1985 | European Pat. Off. | 229/191 |
| 2 410 602 | 6/1979 | France . | |
| 1478806 | 7/1977 | United Kingdom | 229/191 |
| 2 148 254 | 5/1985 | United Kingdom . | |
| 2 196 608 | 5/1988 | United Kingdom . | |
| 93 22206 | 11/1993 | WIPO . | |

*Primary Examiner*—Gary E. Elkins
*Attorney, Agent, or Firm*—Jacobson, Price, Holman & Stern, PLLC

[57] ABSTRACT

The invention relates to a broadsheet from cardboard for constructing a stackable box with corner supports, which box consists in a usual way of a bottom and four side walls, characterized in that two opposite side walls of the box to be made from the broadsheet show extended parts which are folded according to parallel lines and this in such a manner that some sides of these parts which will form in a later phase a corner support are adhered by glue to an adjacent side wall while the other sides of the same parts or a portion thereof are provided with a fasteners which co-operates when constructing the box, i.e. amongst others when forming the corner support, with an analogous fasteners provided on the other adjacent side wall.

9 Claims, 14 Drawing Sheets

BROADSHEET FROM CARDBOARD FOR CONSTRUCTING A STACKABLE BOX AND THUS OBTAINED BOX

This invention relates to a broadsheet from cardboard for constructing a stackable box with corner supports, which box consists in a usual way of a bottom and four side walls.

Cardboard boxes of the intended type are much used in the sector of fruit and vegetable farming. Several of these boxes have to be stackable. Up to now all components of such boxes were glued together where necessary, which required the application of very complicated, relatively heavy machines. It is also clear that the transport to and the storage of such boxes by the user takes in an excessively large volume.

An object of the invention is therefore to design a broadsheet for forming a stackable box which can be constructed, thanks to its concept, quickly manually or with technically simply controllable means into a stackable box.

A very particular object of the invention is to establish a broadsheet onto which certain components are adhered and this in the folded position so that the thickness of the broadsheet with said components is reduced as much as possible. Finally, the invention aims at realising, starting from the broadsheet, a stackable box having a substantially increased bearing power.

In order to enable this in accordance with the invention, two opposite side walls of the box to be made from the broadsheet show extended parts which are folded according to parallel lines and this in such a manner that some sides of these parts which will form in a later phase a corner support are adhered by means of glue to an adjacent side wall while the other sides of the same parts or a portion thereof are provided with a fastening means which co-operates when constructing the box, i.e. amongst others when forming the corner support, with an analogous fastening means provided on the adjacent side wall.

Still according to the invention, said fastening means is a contact glue, by which is meant a glue which provides an efficient and sufficient adhesive strength only when coming into contact with a glue of the same or analogous properties.

According to a possible variant, said fastening means consists of mutually co-operating snapping means.

The invention also relates to the stackable box constructed from the broadsheet according to the invention.

Other details and advantages of the invention will become apparent from the following description of a broadsheet for forming a stackable cardboard box according to the invention. This description is given by way of example and does not limit the invention. The reference numerals relate to the figures annexed hereto.

FIG. 1 shows the broadsheet from which the box will be constructed with the corner supports which are present thereon and which are flat in this phase.

FIGS. 2 to 7 included show, in a perspective view, the successive steps leading to the finished stackable box according to the invention.

Figure 1:
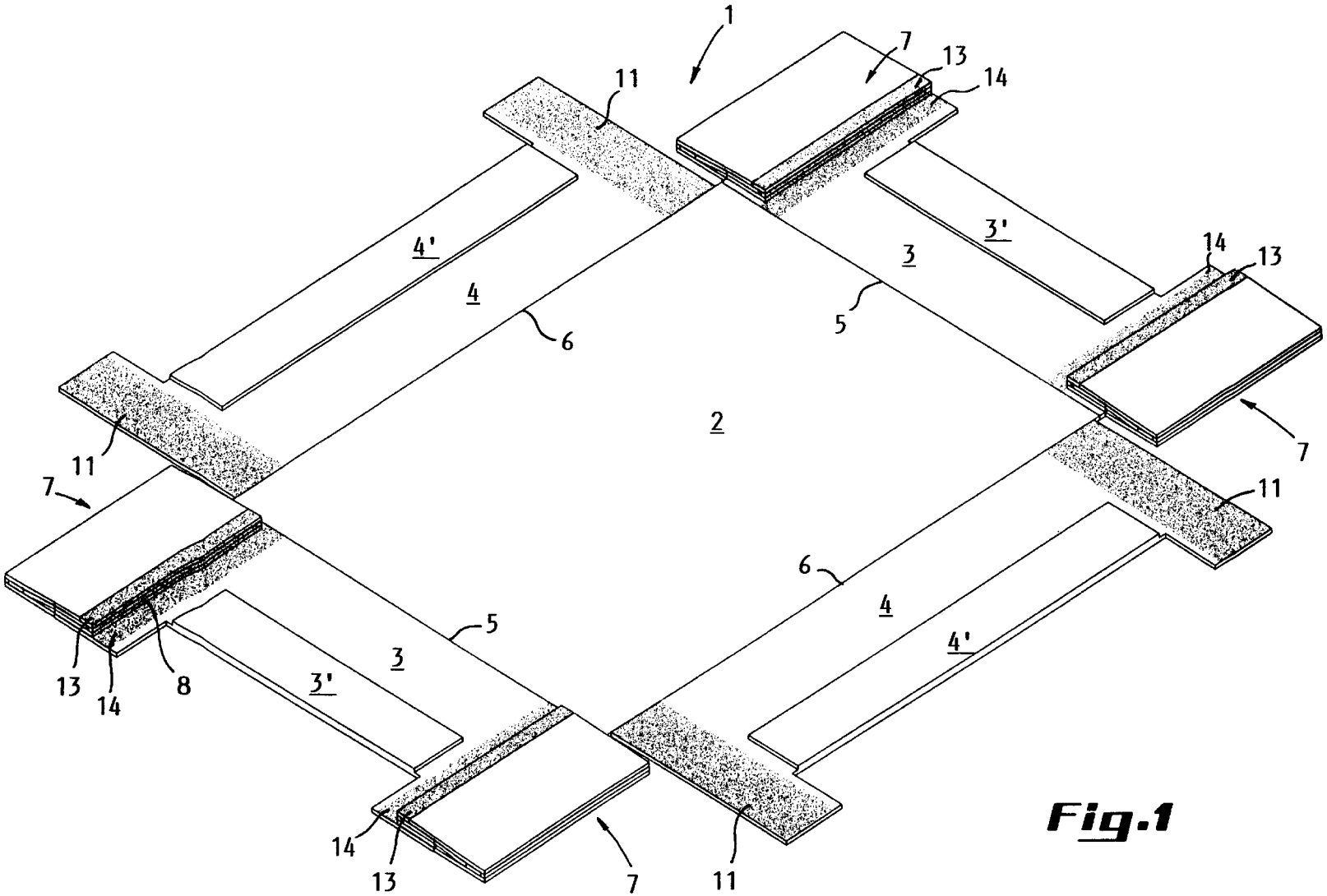
Figure 2:
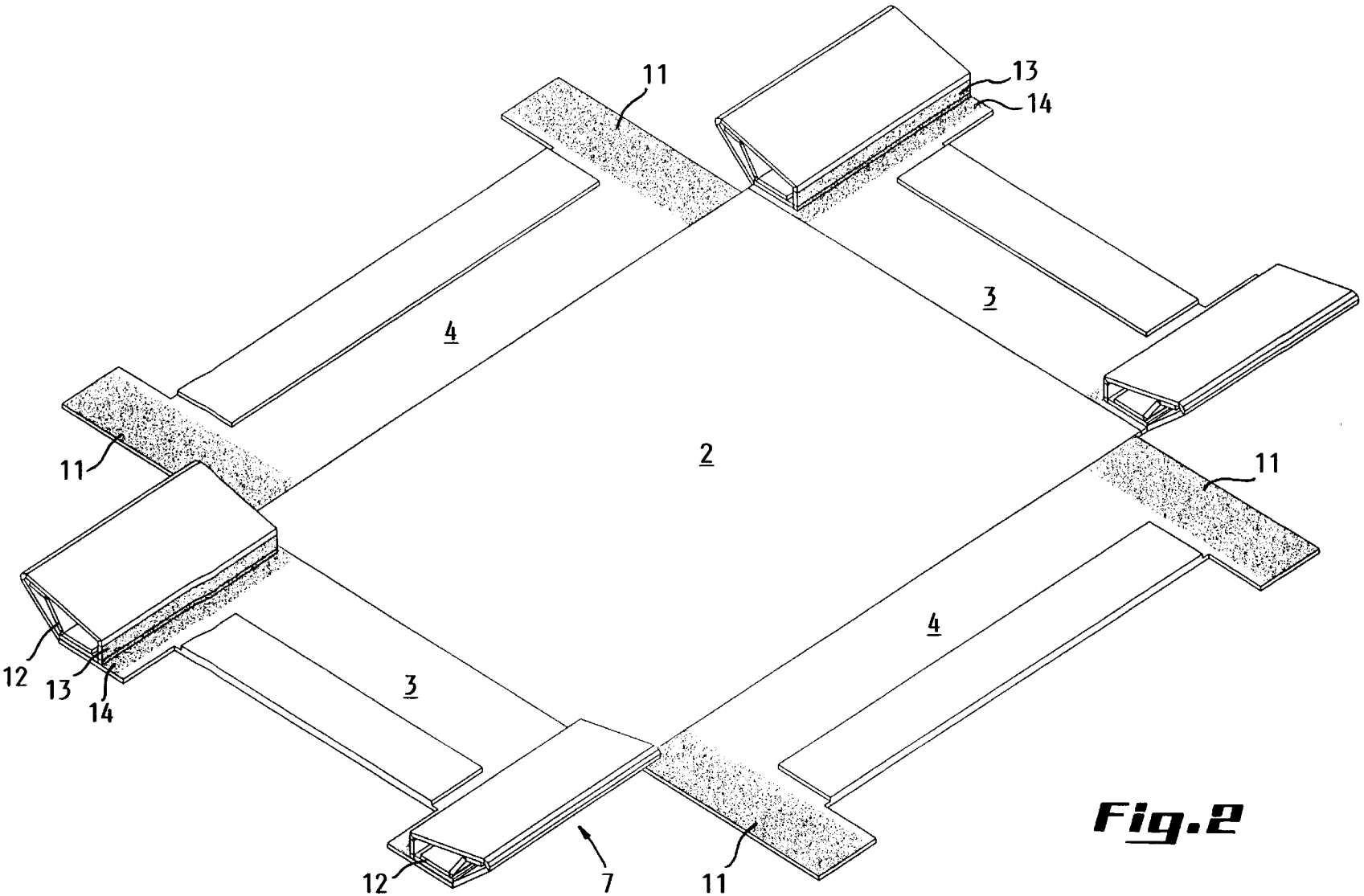
Figure 3:
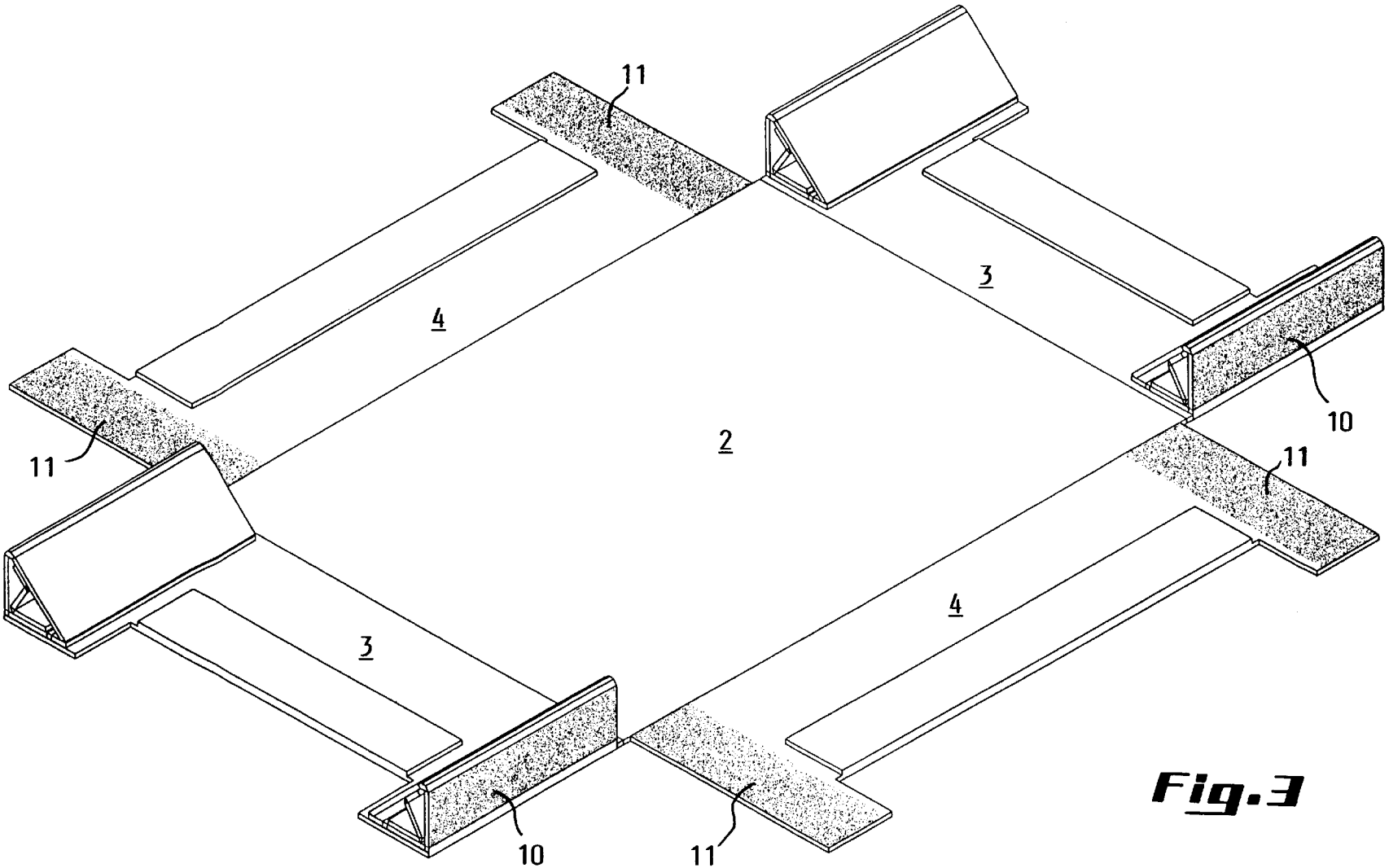
Figure 4:
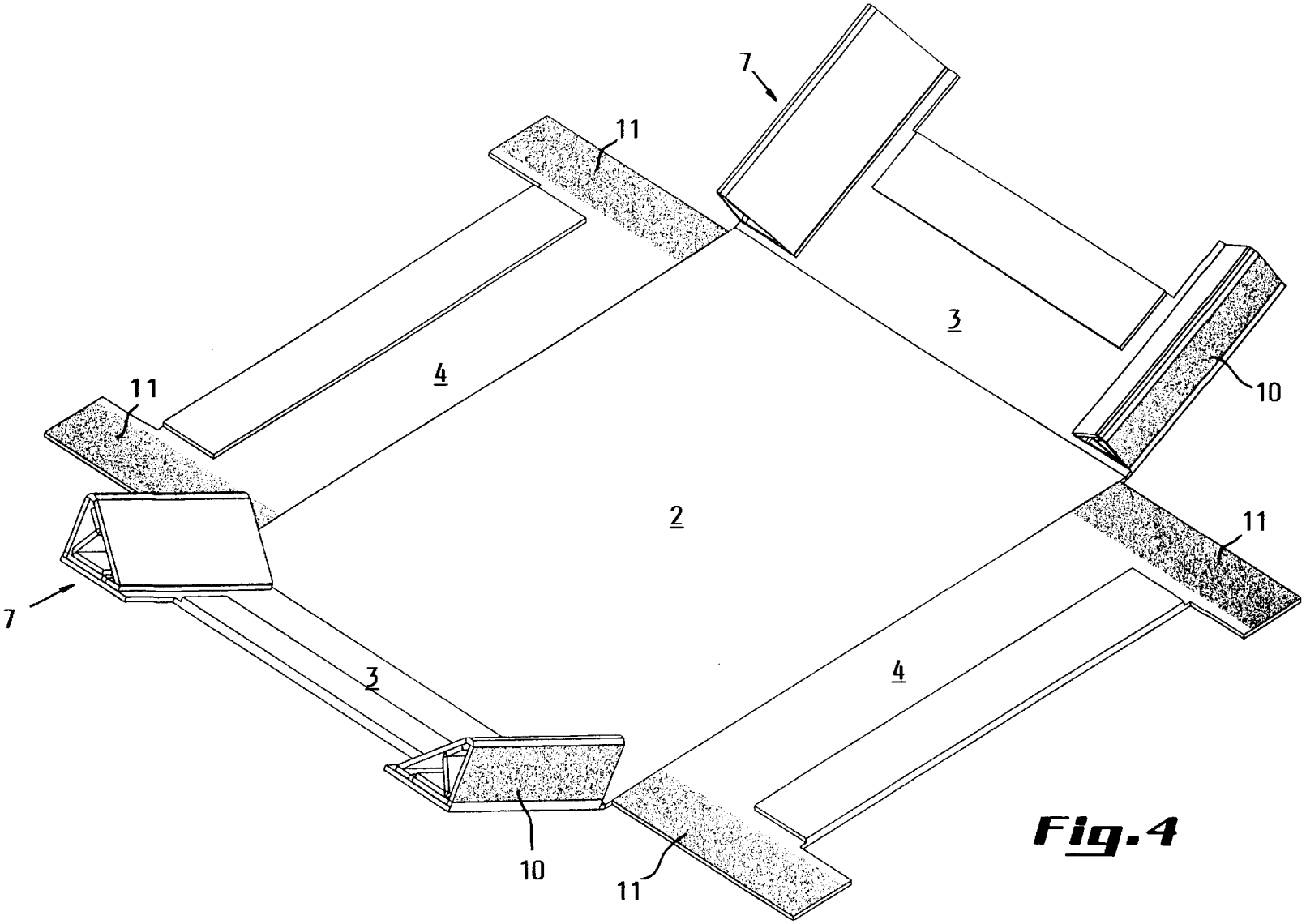
Figure 5:
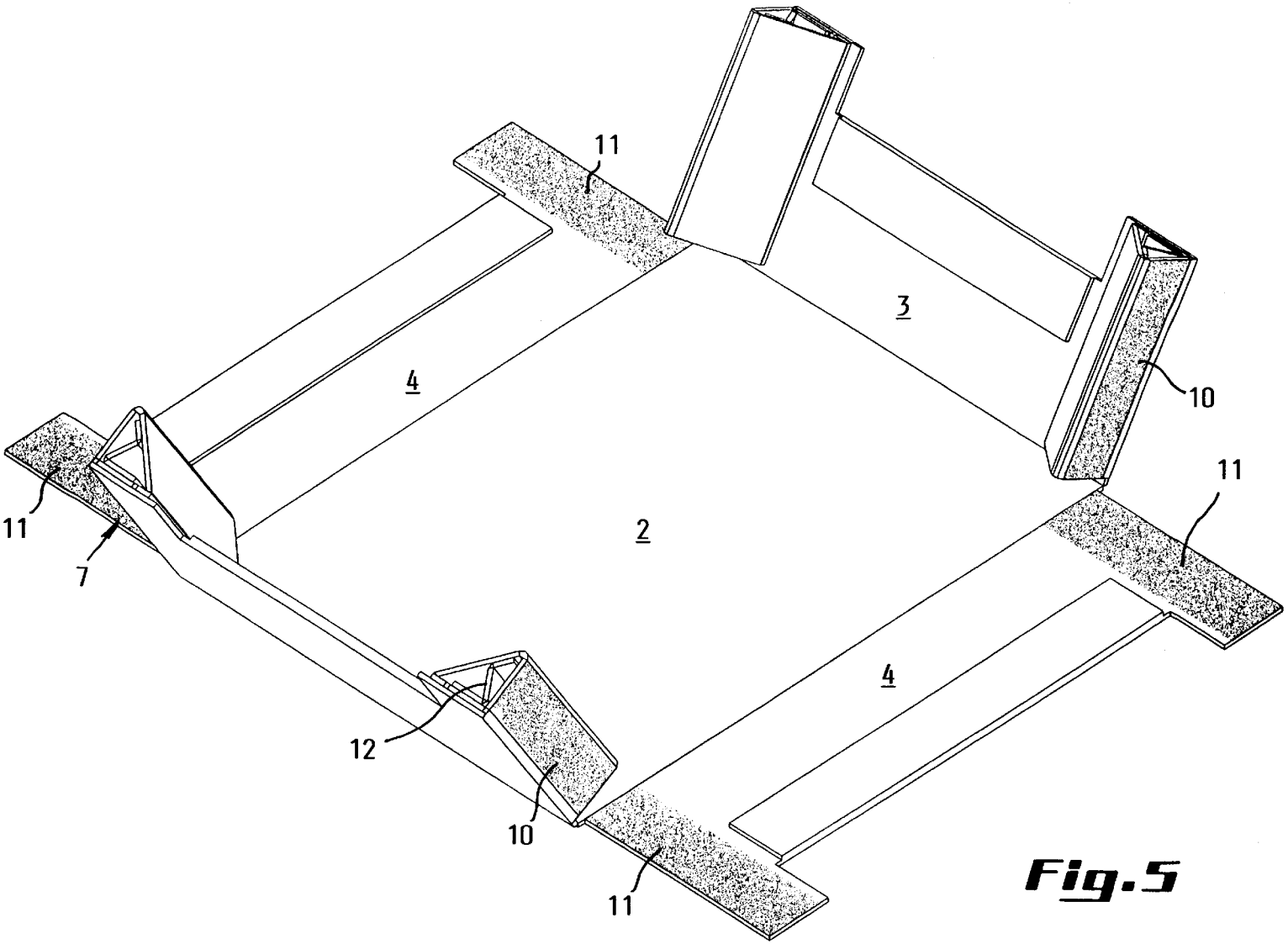
Figure 6:
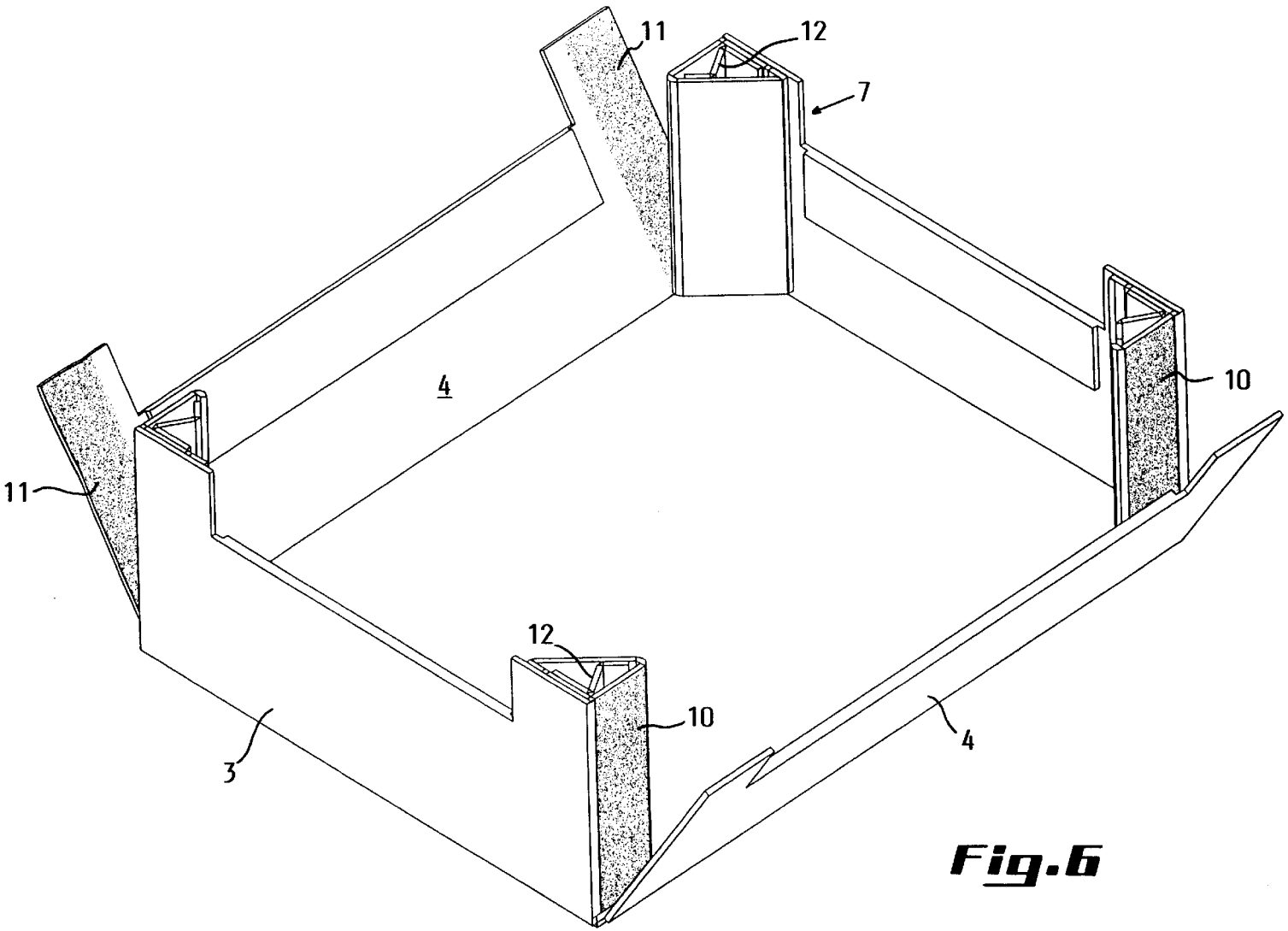
Figure 7:
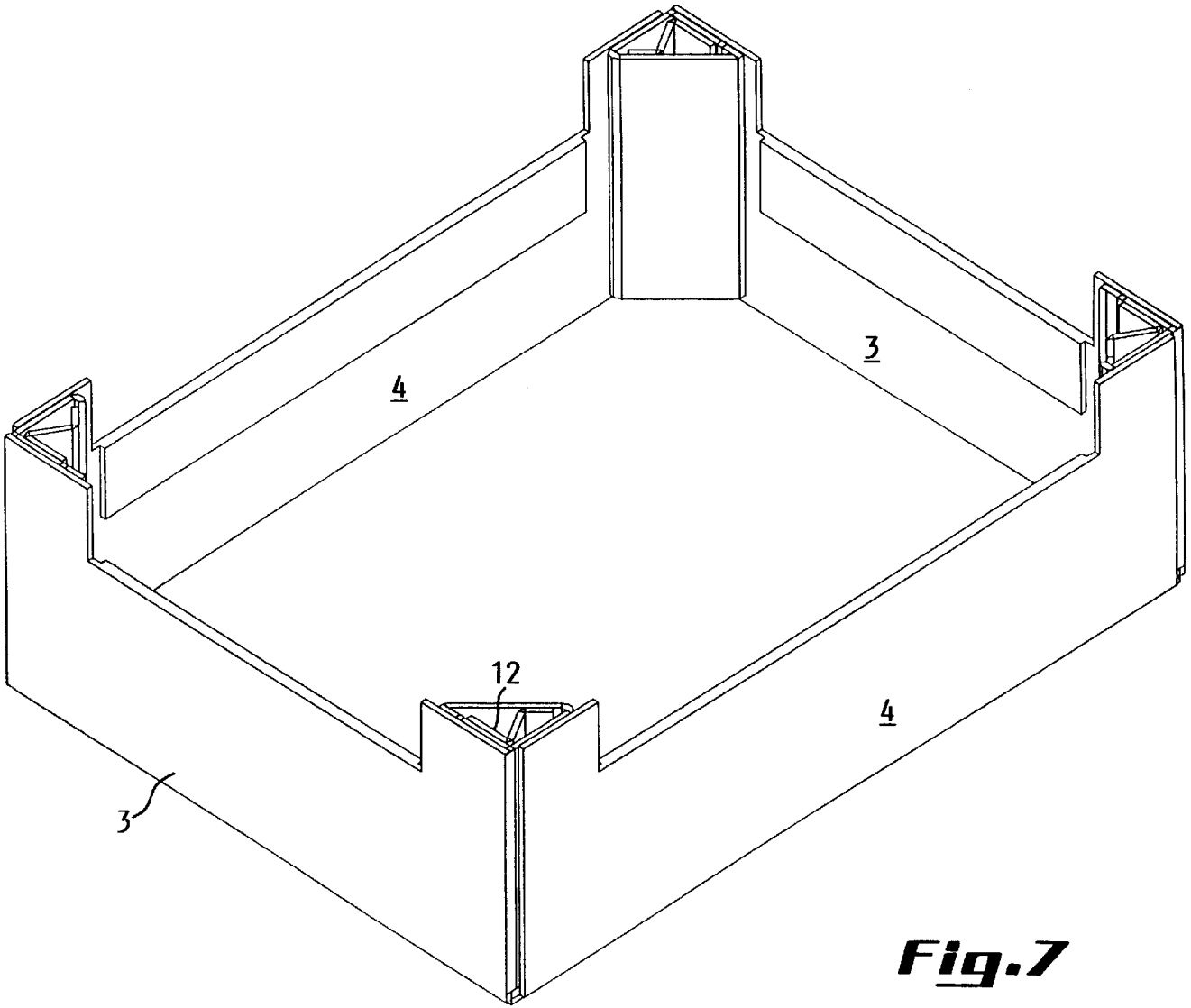

FIGS. 1 to 7 included illustrate the successive steps leading from a broadsheet according to the invention to an entirely constructed box while FIGS. 10 to 15 included clearly show where the strips of glue and contact glue are applied on the inner and respectively the outer side of the broadsheet according to the two embodiments.

The broadsheet 1 according to the different FIGS. 1 to 7 allows the construction of a box consisting of a bottom 2. The bottom which is shown here has a rectangular shape including two short side walls 3 and two long side walls 4. The respective fold lines 5 and 6 determine the dimensions of the bottom 2 which could of course equally show purely square dimensions. In the fruit and vegetable farming, use is much made of boxes of the type illustrated here.

In order to reinforce the side walls 3 and 4, the upper edge of each of these side walls is folded back and the folded portions 3' and 4' thereof are adhered to this end onto the inner side of the short and long side walls.

In this way, raised wall portions are produced at both ends of the side walls 3 and 4 which play a particular role as will be set forth hereinafter.

In the example which is described here the short side walls 3 show extended parts 7 which will be folded according to parallel lines in such a manner that these parts will form corner supports when the box is constructed in the final phase but remain in the folded position part of the broadsheet in the way this can be dispatched to the user and can be stored there under a reduced volume.

Figure 8:
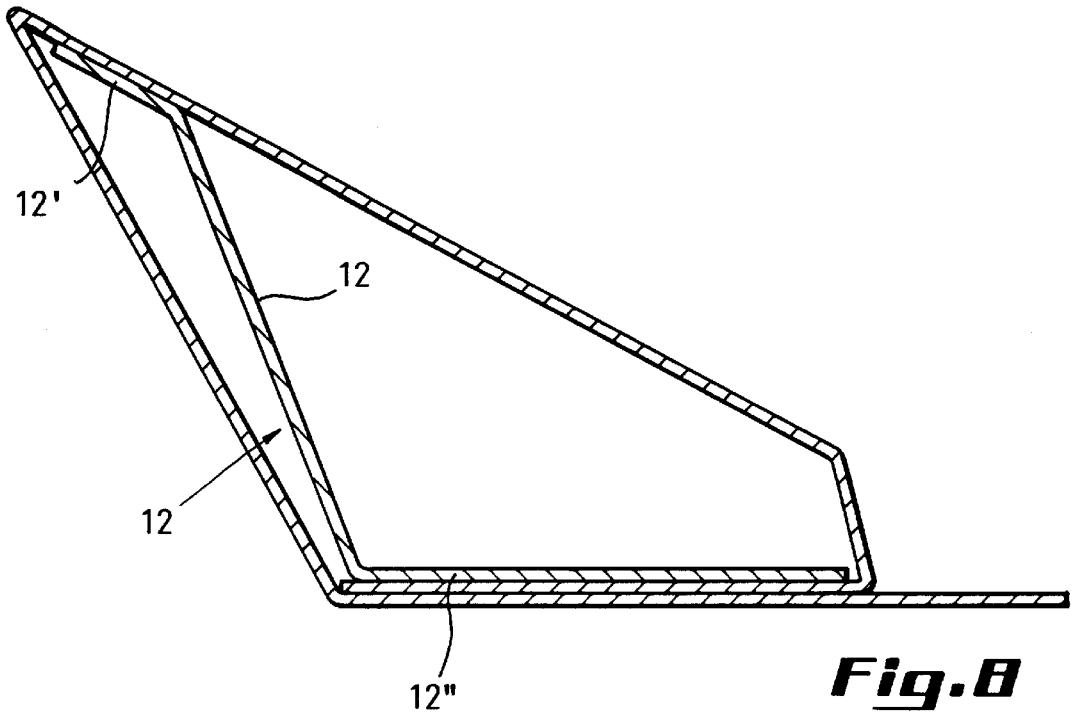
FIGS. 8 and 9 are, on a larger scale, cross-sections of a corner support according to the invention.
Figure 9:
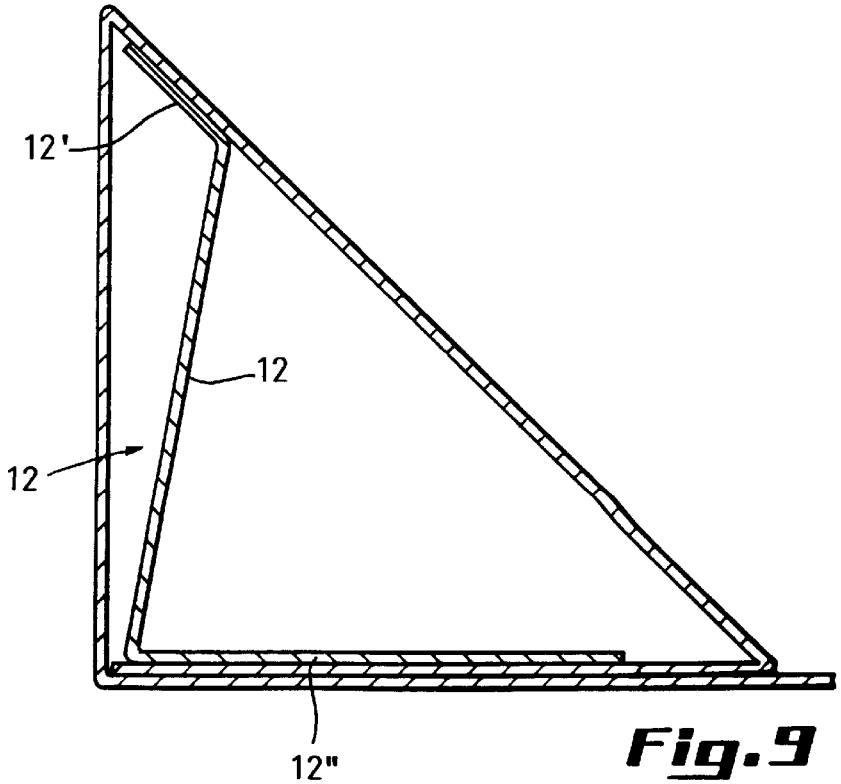
Figure 10:
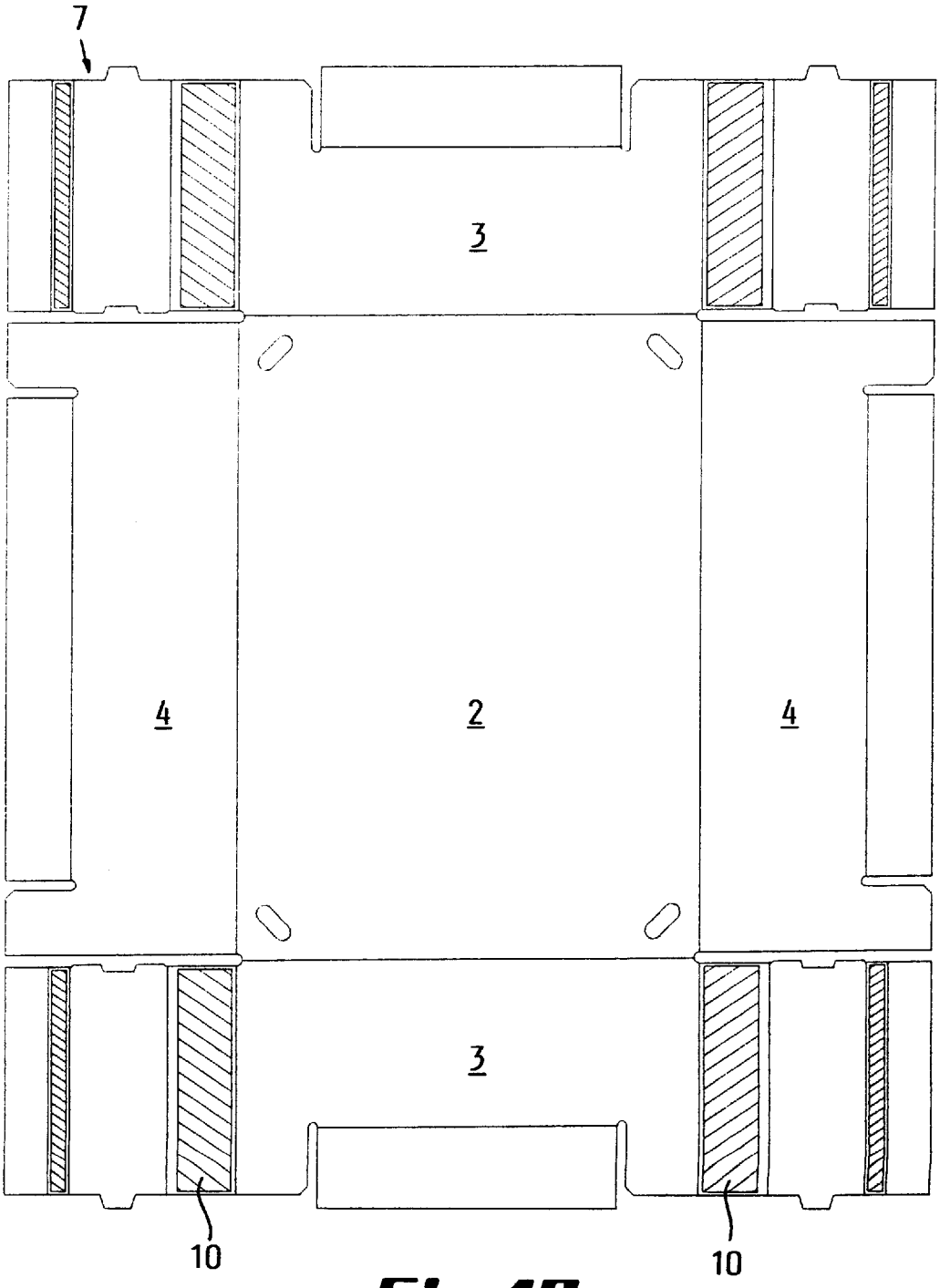
FIG. 10 shows the outer side of the broadsheet (first embodiment) with the strips of contact glue.
Figure 11:
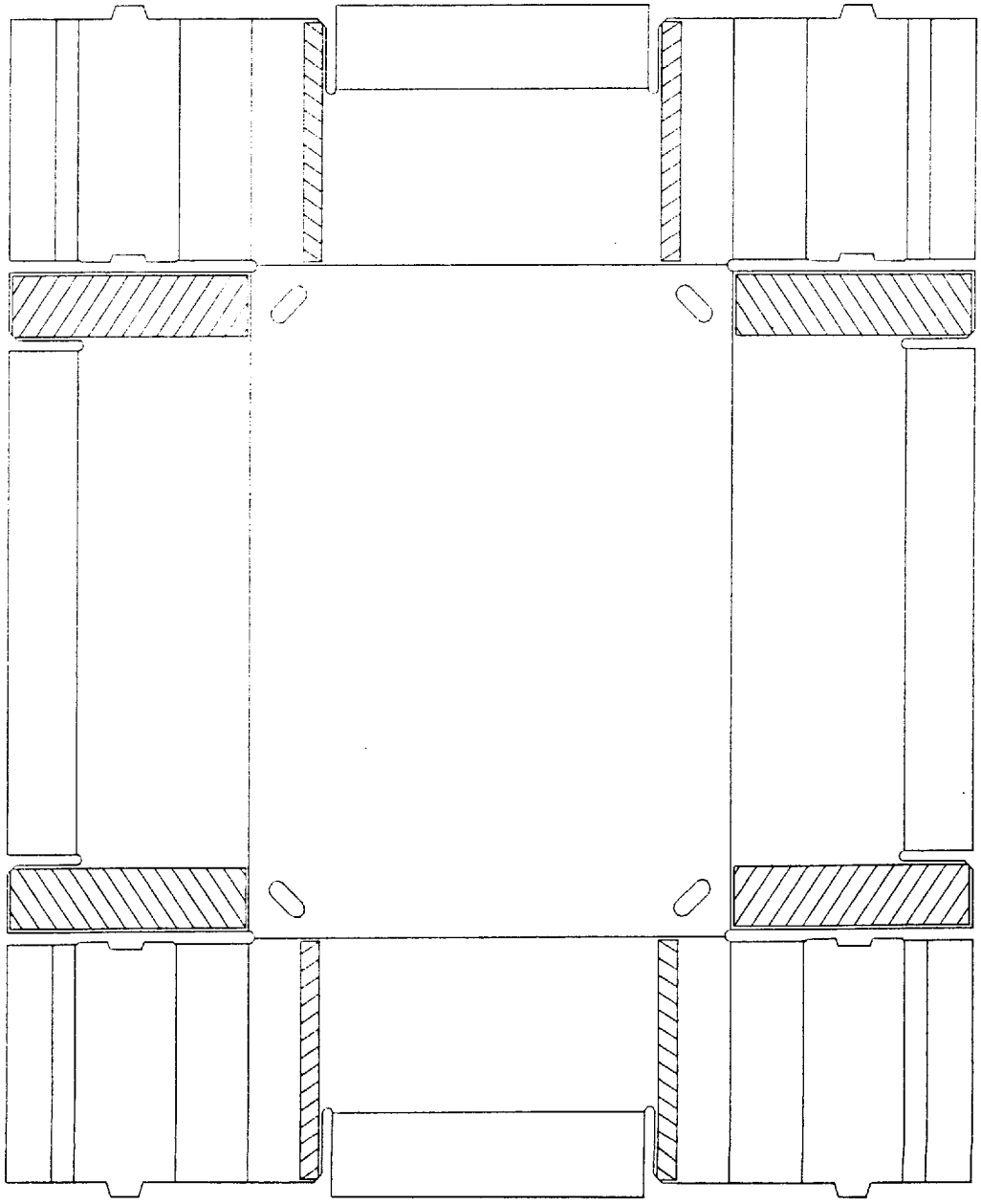
FIG. 11 shows the inner side of the broadsheet (first embodiment) with the strips of contact glue.
Figure 12:
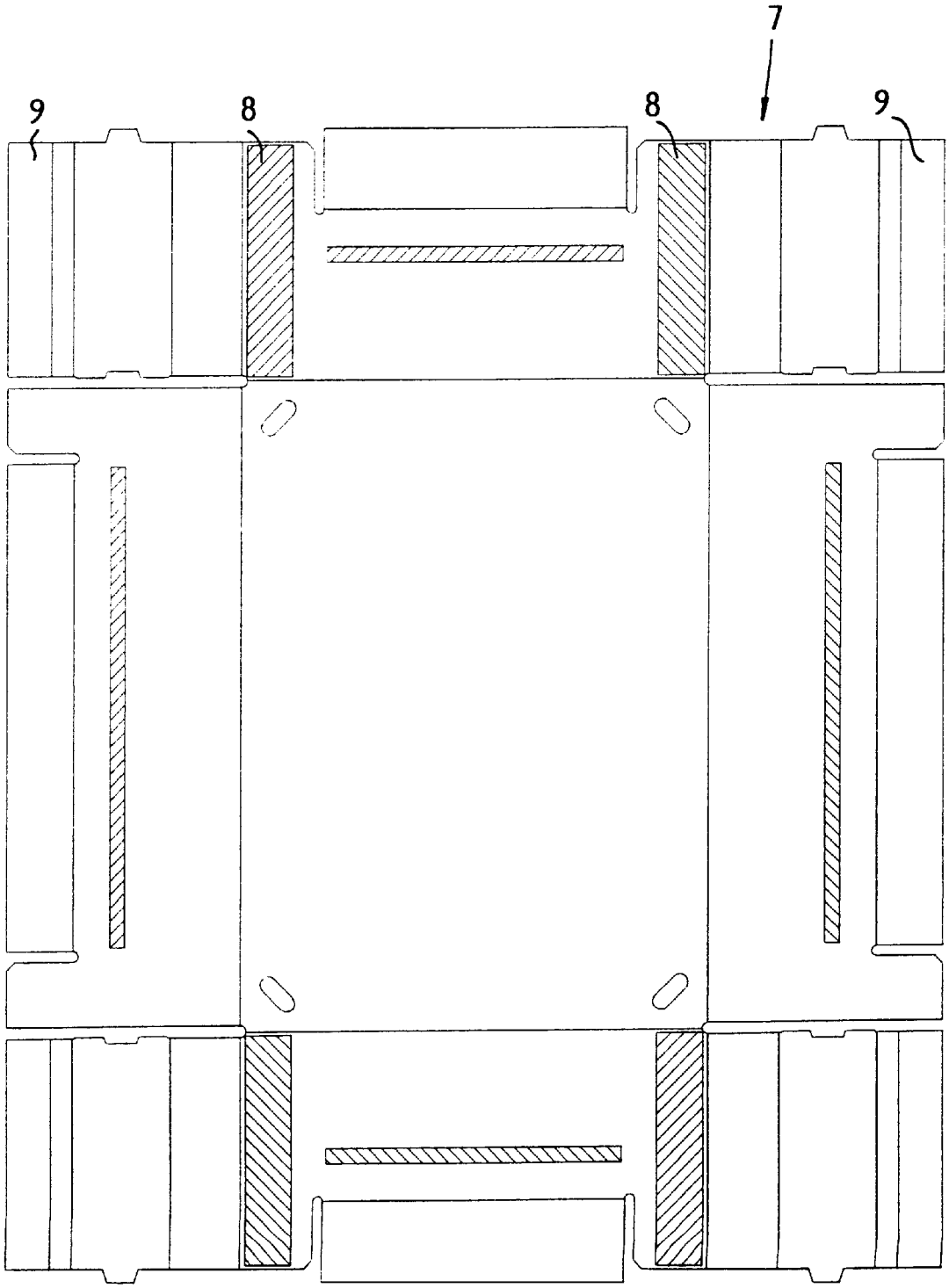
FIG. 12 shows the inner side of the broadsheet (first embodiment) with the strips of glue.

In both embodiments, the inner side of the short side of the broadsheet comprises a strip of glue 8 onto which the back of the side 9 pertaining to said extended part 7 is adhered when this side is brought in the position illustrated amongst others by FIGS. 8 and 9. The components which will form corner supports in the constructed box remain in folded position onto the broadsheet as long as the broadsheet is stored in its substantially flat shape. This position is also illustrated by FIG. 1.

The back of the extended parts 7 of the short sides 3 comprises a strip of contact glue 10. Such strips of contact glue 10 can be seen clearly amongst others in FIGS. 4, 5 and 10.

When constructing the box, this strip of contact glue 10 is going to co-operate with a strip of contact glue 11 applied on the inner side of the long side wall (FIGS. 1 to 6). By contact glue is meant a glue which provides an efficient and sufficient adhesive strength only when it is put into contact with a glue of the same or analogous properties. Consequently, such a contact glue maintains its full adhesive strength when it is exposed for long periods to the air, namely in the unconstructed state of the box. From this it is immediately apparent that the broadsheet can be stored for a long time and this under a volume which is reduced as much as possible.

In order to increase the bearing power of the box, a reinforcement strip 12 is applied in each corner support. In the constructed state of the box, and therefore also of the corner supports, the reinforcement strip 12 shows a Z-shaped cross profile (FIG. 9). In the folded state, the reinforcement strip 12 is lying flat. Indeed, the reinforcement strip 12 is adhered by its sides 12' and 12" internally onto the inner wall of the folded extended part of the small side wall 3 (FIGS. 8, 9).

A very particular characteristic of the components which form the extended parts of the short side walls and which will form in a later phase corner supports, is the presence of a strip of contact glue 13 which is going to co-operate when constructing the box with a strip of contact glue 14 on the inner side of the short side walls 3 (FIG. 1).

Figure 13:
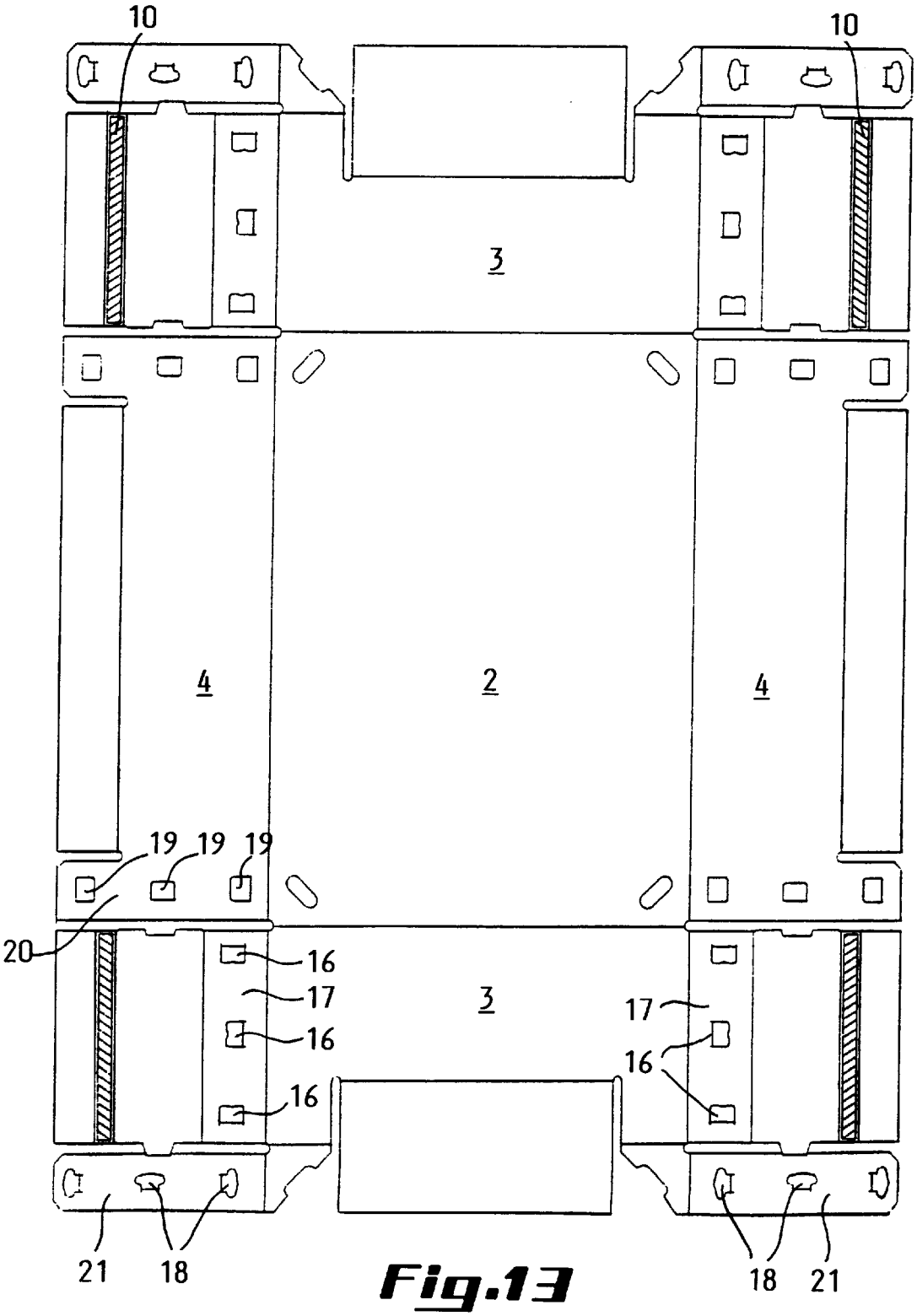
FIG. 13 shows the outer side of the broadsheet (second embodiment) with the strips of contact glue.
Figure 14:
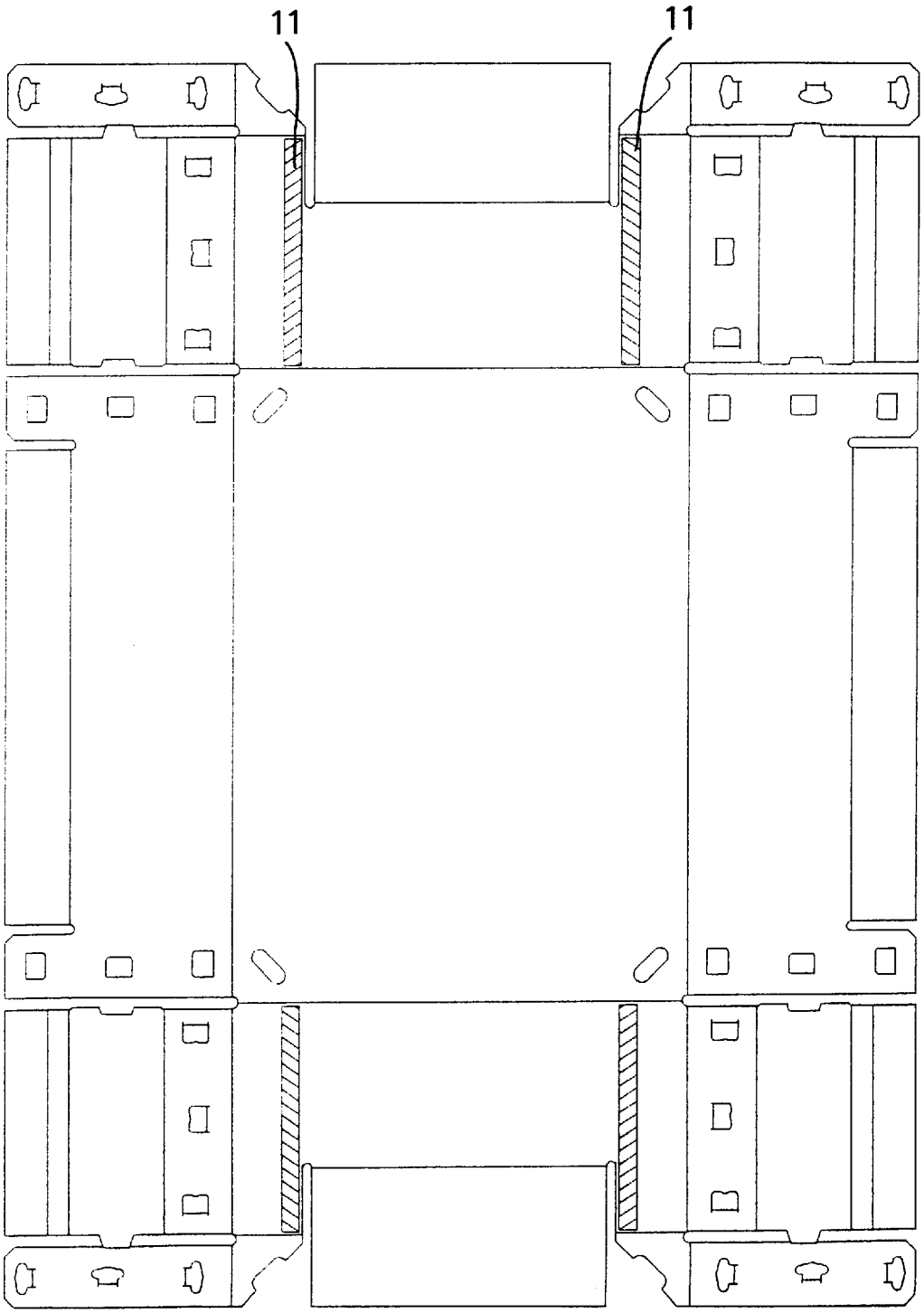
FIG. 14 shows the inner side of the broadsheet (second embodiment) with the strips of contact glue.
Figure 15:
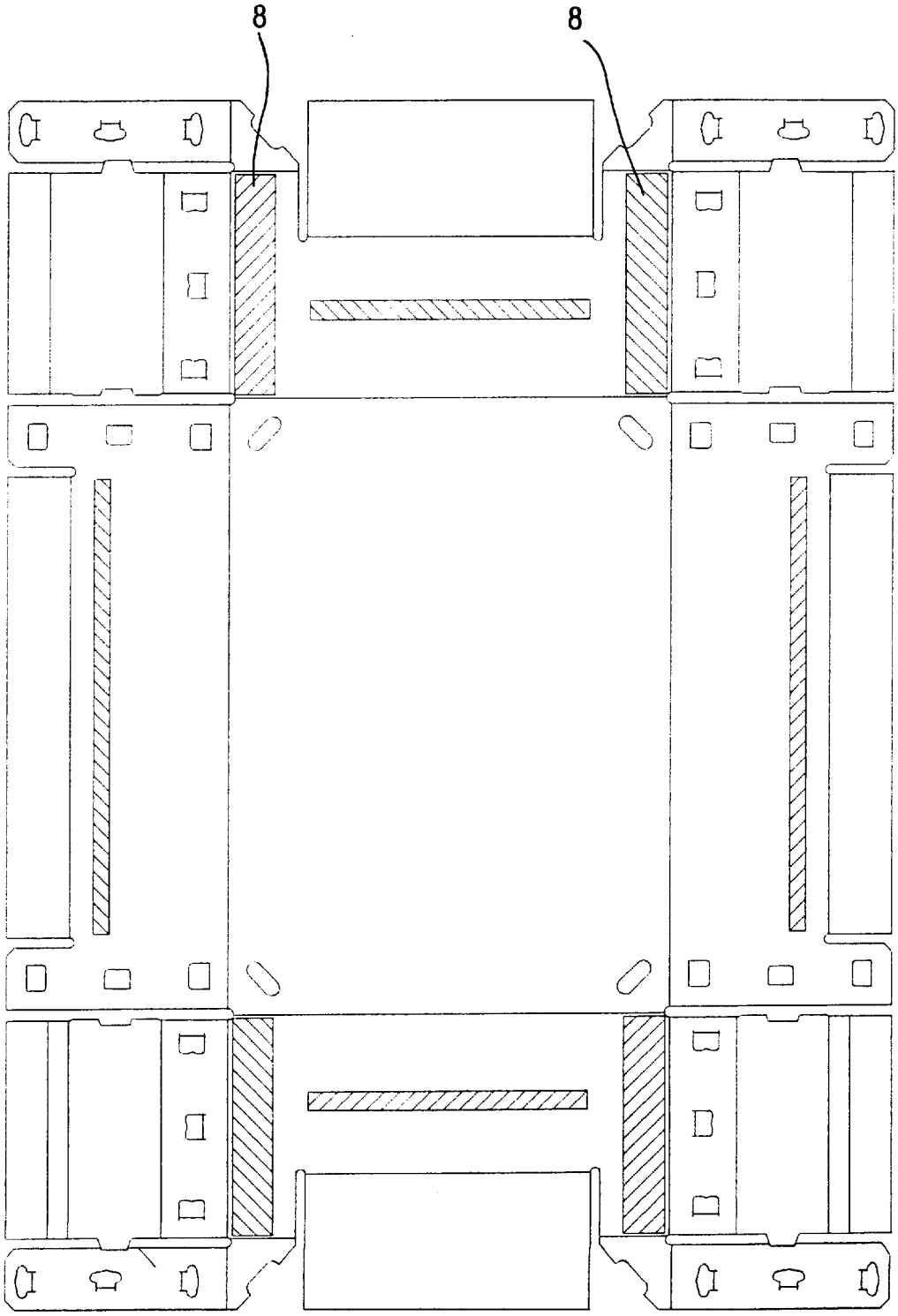
FIG. 15 shows the inner side of the broadsheet (second embodiment) with the strips of glue.

In the second embodiment to which FIGS. 13, 14 and 15 relate, the connection between the corner supports 7 and the parts 15 which are present on both extremities of the large side walls 4 is realised by making use of snapping means. The snapping means consist of a series of apertures 16 (FIGS. 13, 14, 15) which are present on a first side 17, i.e. the side which is connected to a short side 3, and a series of male elements 18 (FIGS. 13, 14, 15) which penetrate through the intended apertures after being pushed through a similar series of apertures 19 situated along the edge 20 of the long side walls 4. The male elements 18 of the snap connection are provided on a strip of cardboard 21 which is connected to the utmost edge of a short side wall so as to be foldable over an angle of 90°.

In order to clarify FIGS. 10 to 15 included, one will notice that the shaded portions refer to glue, respectively contact glue, as set forth in the above intended explanation of the figures.

From the hereinabove given description of the broadsheet according to the invention and of the box constructed therefrom, it appears that a box can be constructed as well manually as by making use of technically simply controllable mechanical means starting from the intended broadsheet, the storage space of which has been reduced at the user as much as possible.

I claim:

1. A broadsheet from cardboard for constructing a stackable box with corner supports, which box comprises a bottom and four side walls, said four side walls corresponding to two opposite side walls and two side walls adjacent said opposite side walls, characterized in that the two opposite side walls of the box to be made from the broadsheet are adhered to extended parts, each extended part being folded according to parallel lines in such a manner that forms a first side of the extended part, by which the extended part is adhered by means of glue to said opposite side wall, and a second side of the extended part, said second side being provided with a fastening means which co-operates, when constructing the box and forming the corner support, with an analogous fastening means provided on one of the two side walls adjacent the opposite side walls.

2. A broadsheet according to claim 1, characterized in that said fastening means comprises a contact glue which provides an efficient and sufficient adhesive strength when coming into contact with a glue of same or analogous properties.

3. A broadsheet according to claim 1, characterized in that said fastening means comprises mutually co-operating snapping means.

4. A broadsheet according to claim 2 characterized in that said fastening means further comprises mutually co-operating snapping means.

5. A broadsheet according to claim 1, characterized in that a) said first side is adhered to said opposite side by one of two parallel strips, and another of said two strips is provided with fastening means for co-operating, in a constructed state of the box, with analogous fastening means provided on the on the opposite side wall;

b) said second side is connected to the first side and to a third side of said extended part which is provided with fastening means for co-operating, in the constructed state of the box, with analogous fastener means on a one of the side walls adjacent the opposite side walls.

6. A broadsheet according to claims 3 characterized in that two opposite side walls show extended parts which will serve as corner supports when constructing the box, which extended parts are folded in such a manner according to parallel lines that the following sides are formed, namely a) a first side, i.e. the side which is connected to the intended side wall and which shows fastening means in the form of a series of apertures;

b) a second side which is connected, on the one hand, to the first side and, on the other hand, to a third side which is glued onto the respective side wall, the opposite side walls which extend between the first mentioned side walls show at both ends apertures for the passage of the male elements of said snapping means present on a strip of cardboard which is connected to the edge of the first mentioned walls so as to be foldable over an angle of 90°.

7. A broadsheet according to claim 1, characterized in that a reinforcement strip is provided, attached to an inner wall of the extended part.

8. A broadsheet according to claim 7, characterized in that when the corner supports are formed, said reinforcement strip forms a Z-shaped cross-profile.

9. A broadsheet according to claim 1 constructed into a stackable cardboard box.

* * * * *